US009904214B2

(12) United States Patent
Kakehi

(10) Patent No.: US 9,904,214 B2
(45) Date of Patent: Feb. 27, 2018

(54) IMAGE FORMING APPARATUS HAVING TRANSFER BELT CONFIGURED TO AVOID IMAGE DEFECTS

(71) Applicant: CANON KABUSHIKI KAISHA, Tokyo (JP)

(72) Inventor: Yutaka Kakehi, Kashiwa (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 15/160,181

(22) Filed: May 20, 2016

(65) Prior Publication Data

US 2016/0357129 A1 Dec. 8, 2016

(30) Foreign Application Priority Data

Jun. 2, 2015 (JP) ..... 2015-112020
Mar. 2, 2016 (JP) ..... 2016-040270

(51) Int. Cl.
*G03G 15/01* (2006.01)
*G03G 15/14* (2006.01)
(Continued)

(52) U.S. Cl.
CPC ..... *G03G 15/1605* (2013.01); *G03G 15/1615* (2013.01); *G03G 15/6558* (2013.01)

(58) Field of Classification Search
CPC ..... G03G 15/1605; G03G 15/1615; G03G 15/6558
(Continued)

(56) References Cited

U.S. PATENT DOCUMENTS 6,697,595 B2 2/2004 Kawagoe et al.
8,693,901 B2 4/2014 Watanabe et al.
(Continued)

FOREIGN PATENT DOCUMENTS

EP 1 186 964 A3 3/2002
JP 2000-293066 A 10/2000
(Continued)

OTHER PUBLICATIONS

U.S. Appl. No. 15/175,583, Yutaka Kakehi, filed Jun. 7, 2016.
Extended European Search Report dated Oct. 10, 2016, in European Patent Application No. 16170782.3.

*Primary Examiner* — Susan Lee
(74) *Attorney, Agent, or Firm* — Fitzpatrick, Cella, Harper & Scinto

(57) ABSTRACT

An image forming apparatus includes a belt, image forming unit, first and second transfer rollers, feeding portion, stretching roller and urging member. Regarding (1) a contact point between (i) an outer common tangential line between the stretching and first transfer rollers and (ii) the first transfer roller and (2) an intersection point between (i) the outer common tangential line and (ii) a line perpendicular to the outer common tangential line and passing through a rotation center of the second transfer roller, the contact point is closer to the stretching roller than the intersection point is to the stretching roller and a distance between the contact and intersection points is 5% or more of a diameter of the first transfer roller. The urging member urges the belt from an inner belt surface at a position, close to a transfer portion, between the first transfer roller and the belt.

9 Claims, 5 Drawing Sheets

(51) Int. Cl.
*G03G 15/16* (2006.01)
*G03G 15/00* (2006.01)

(58) Field of Classification Search
USPC ..... 399/302, 308, 313
See application file for complete search history.

(56) References Cited

U.S. PATENT DOCUMENTS

| | | | | |
|---|---|---|---|---|
| 8,787,805 | B2 | 7/2014 | Nakajima | |
| 9,229,374 | B2 | 1/2016 | Kakehi | |
| 9,348,266 | B2 | 5/2016 | Kakehi | |
| 2008/0069605 | A1* | 3/2008 | Fuwa et al. | 399/302 |
| 2009/0208257 | A1 | 8/2009 | Matsumoto | |
| 2011/0026954 | A1 | 2/2011 | Kishi | |
| 2015/0286166 | A1 | 10/2015 | Kokubo et al. | |
| 2015/0346645 | A1 | 12/2015 | Kakehi | |

FOREIGN PATENT DOCUMENTS

| | | | |
|---|---|---|---|
| JP | 2002-082543 | A | 3/2002 |
| JP | 2010-139603 | A | 6/2010 |
| JP | 2011-064823 | A | 3/2011 |
| JP | 2012-168396 | A | 9/2012 |
| JP | 2013-019934 | A | 1/2013 |

* cited by examiner

IMAGE FORMING APPARATUS HAVING TRANSFER BELT CONFIGURED TO AVOID IMAGE DEFECTS

FIELD OF THE INVENTION AND RELATED ART

The present invention relates to an image forming apparatus such as a printer, a facsimile machine or a copying machine.

In an image forming apparatus using an intermediary transfer belt, a toner image carried on the intermediary transfer belt is transferred onto a transfer belt supported by a transfer roller toward the intermediary transfer belt or a recording material at a transfer portion where the transfer is contacted to the intermediary transfer belt.

In the image forming apparatus using the intermediary transfer belt, the recording material may preferably be superposed on the intermediary transfer belt on an upstream side close to the transfer portion and then is introduced into the transfer portion. This is because a high voltage is applied to the transfer portion and a strong electric field generates at the transfer portion, and therefore when the recording material is superposed on a rotatable transfer member and then is introduced into the transfer portion, electric discharge generates between the intermediary transfer belt and the recording material, and thus an image defect is liable to generate.

In Japanese Laid-Open Patent Application (JP-A) 2002-82543, a supporting member is provided on a side upstream of a transfer portion so as to support an inner peripheral surface of an intermediary transfer belt, whereby a region where a recording material is stably contacted to the intermediary transfer belt is formed on the upstream side close to the transfer portion.

In the image forming apparatus in which the supporting member is provided on the side upstream of the transfer portion, when an image is formed on a recording material having a large weight per unit area, a portion of the recording material positioned upstream of the transfer portion rubs the intermediary transfer belt, so that an image defect due to disturbance of a toner image before transfer is liable to generate.

SUMMARY OF THE INVENTION

According to an aspect of the present invention, there is provided an image forming apparatus comprising: an endless intermediary transfer belt; a toner image forming unit configured to form a toner image on the intermediary transfer belt; a first transfer roller contacting an inner peripheral surface of the intermediary transfer belt; a second transfer roller configured to sandwich the intermediary transfer belt between itself and the first transfer roller to form a transfer portion where the toner image is transferred from the intermediary transfer belt onto a recording material; feeding means configured to feed the recording material to the transfer portion; a stretching roller, provided downstream of the toner image forming unit and upstream of the first transfer roller with respect to a movement direction of the intermediary transfer belt, configured to stretch the intermediary transfer belt between itself and the first transfer roller in contact with the inner peripheral surface of the intermediary transfer belt, wherein as seen in a direction of a rotational axis of the first transfer roller, a contact point between an outer common tangential line, on a stretching side of the intermediary transfer belt by the first transfer roller, between the stretching roller and the first transfer roller and the first transfer roller and an intersection point between the outer common tangential line and a rectilinear line which is perpendicular to the outer common tangential line and which passes through a rotation center of the second transfer roller satisfy that the contact point is closer to the stretching roller than the intersection point is and that a distance between the contact point and the intersection point is 5% or more of a diameter of the first transfer roller; and an urging member configured to urge the intermediary transfer belt from the inner peripheral surface of the intermediary transfer belt at a position close to the transfer portion between the first transfer roller and the intermediary transfer belt.

Further features of the present invention will become apparent from the following description of exemplary embodiments with reference to the attached drawings.

DESCRIPTION OF THE EMBODIMENTS

Embodiments of the present invention will be described specifically with reference to the drawings.

Embodiment 1

(Image Forming Apparatus)

Figure 1:
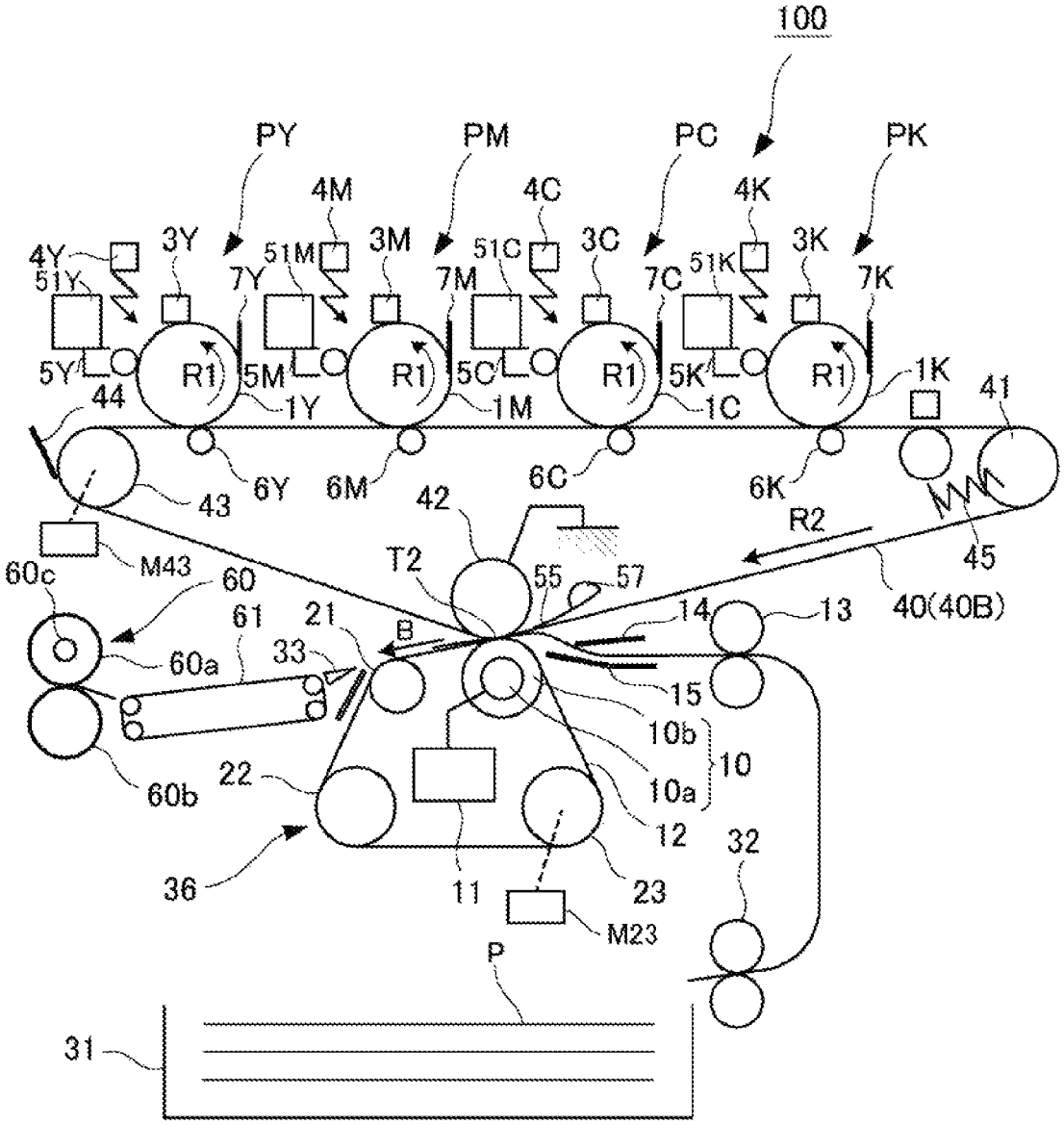
FIG. 1 is an illustration of a structure of an image forming apparatus.

FIG. 1 is an illustration of a structure of an image forming apparatus 100. As shown in FIG. 1, the image forming apparatus 100 is an intermediary transfer type full color printer of a tandem type in which image forming portions PY, PM, PC and PK are arranged along an upward surface of an intermediary transfer belt 40.

In the image forming portion PY, a yellow toner image is formed on a photosensitive drum 1Y and then is primary-transferred onto the intermediary transfer belt 40. In the image forming portion PM, a magenta toner image is formed on a photosensitive drum 1M and then is primary-transferred onto the intermediary transfer belt 40. In the image forming portions PC and PK, cyan and black toner images are formed on photosensitive drums 1C and 1K, respectively, and then are primary-transferred onto the intermediary transfer belt 40.

The four color toner images transferred on the intermediary transfer belt 40 are fed to a secondary transfer portion T2, and are secondary-transferred onto a recording material P. The recording material P is taken out from a recording material cassette 31, and is separated one by one by a separation roller 32, and then is fed to a registration roller pair 13. The registration roller pair 13 sends the recording material P to the secondary transfer portion T2 while timing the recording material P to the toner images on the intermediary transfer belt 40.

A transfer belt unit 36 is contacted to the intermediary transfer belt 40 supported by an inner secondary transfer roller 42, so that the secondary transfer portion T2 is formed. A transfer voltage source 11 applies a DC voltage to an outer secondary transfer roller 10, and the toner images are secondary-transferred from the intermediary transfer belt 40 onto the recording material being fed through the secondary transfer portion T2.

The recording material P on which the four color toner images are secondary-transferred is fed into a fixing device 60 by being fed by a pre-feeding device 61 for the fixing device 60, and then is heated and pressed by the fixing device 60, so that the toner images are fixed on the surface of the recording material P. The fixing device 60 melts and fixes the toner images on the recording material P by applying predetermined pressure and predetermined heat quantity to the recording material P in a nip formed by a fixing roller 60*a*, in which a heater 60*c* is provided, and a pressing roller 60*b*.

(Image Forming Portion)

The image forming portions PY, PM, PC and PK have the substantially same constitution except that colors of toners used in developing devices 5Y, 5M, 5C and 5K are yellow, magenta, cyan and black, respectively, which are different from each other. In the following, the image forming portion PY (for yellow) is described, and redundant explanation about other image forming portions PM, PC and PK will be omitted.

The image forming portion PY includes, at a periphery of the photosensitive drum 1Y, a charging device (charger) 3Y, an exposure device 4Y, the developing device 5Y, a primary transfer roller 6Y and a drum cleaning device 7Y. The photosensitive drum 11 is prepared by forming a photosensitive layer on an outer peripheral surface of an aluminum cylinder, and rotates in an arrow R1 direction at a predetermined process speed. In this embodiment, the process speed is 300-500 mm/sec.

The charging device 3Y electrically charges the surface of the photosensitive drum 1Y to a uniform negative potential. The exposure device 4Y scans the surface of the photosensitive drum 1Y with a laser beam, through a rotating mirror, which is ON/OFF-modulated by an image signal obtained by developing image data on a scanning line, so that an electrostatic latent image for an image is written (formed) on the surface of the photosensitive drum 1Y. The developing device 5Y develops the electrostatic latent image into the toner image by transferring the toner on the photosensitive drum 1Y. A developer supplying portion 51Y supplies the toner, in an amount corresponding to an amount of the toner taken out from the developing device 5Y with the image formation, to the developing device 5Y.

In this embodiment, a reverse development type in which the toner is deposited on the exposed portion of the electrostatic latent image to develop the electrostatic latent image is employed. The electrostatic latent image formed by the exposure device 4Y is a group of small dot images, and a density of the toner image formed on the photosensitive drum 1Y is changed by changing a density of the dot images. Each of the respective color toner images transferred onto the recording material P is about 1.5-1.7 in maximum reflection density. A toner amount per unit area of each toner image at the maximum reflection density is about 0.4-0.6 mg/cm$^2$.

The primary transfer roller 6Y forms a primary transfer portion between the photosensitive drum 1Y and the intermediary transfer belt 40. A DC voltage is applied to the primary transfer roller 6Y, whereby a negative toner image carried on the photosensitive drum 1Y is transferred onto the intermediary transfer belt 40. The drum cleaning device 7Y rubs the photosensitive drum 1Y with a cleaning blade, and thus collects a transfer residual toner deposited on the surface of the photosensitive drum 1Y.

(Intermediary Transfer Belt)

Figure 2:
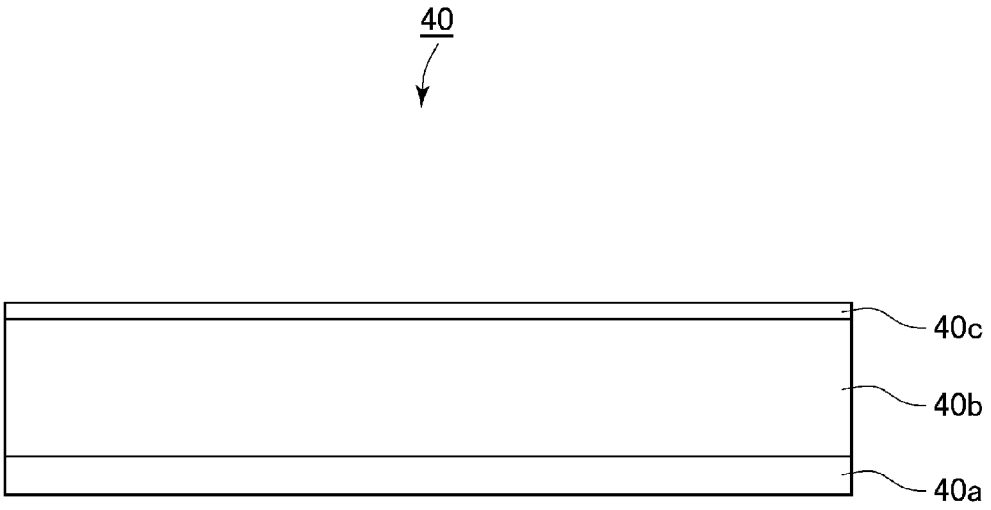
FIG. 2 is an illustration of an elastic layer of an intermediary transfer belt.

FIG. 2 is an illustration of an elastic layer of the intermediary transfer belt. As shown in FIG. 1, the intermediary transfer belt 40 is stretched by a driving roller 43, a tension roller 41 and the inner secondary transfer roller 42, and is driven by the driving roller 43, so that the intermediary transfer belt 40 is rotated in an arrow R2 direction at the above-described process speed. The tension roller 41 is urged outwardly by an urging spring 45 at each of end portions thereof, so that tension of the intermediary transfer belt 40 is controlled at a substantially certain level of about 2-5 kg with respect to a feeding direction. The inner secondary transfer roller 42 is connected with a ground potential and supports an inner peripheral surface of the intermediary transfer belt 40 passing through the secondary transfer portion T2. A belt cleaning device 44 rubs the intermediary transfer belt 40 with a cleaning blade, and thus collects a transfer residual toner from the surface of the intermediary transfer belt 40.

As shown in FIG. 2, the intermediary transfer belt 40 includes an elastic layer 40*b*. The intermediary transfer belt 40 is an endless belt having a 3-layer structure in which a base layer 40*a*, the elastic layer 40*b* and a parting layer 40*c* are laminated from an inner peripheral surface side. The intermediary transfer belt 40 is adjusted to have a volume resistivity of $1\times10^9$-$1\times10^{14}$ Ω·cm by adding an electroconductive agent such as carbon black therein.

The base layer 40*a* is formed using a resin material such as polyimide or polycarbonate, and a thickness thereof is 70-100 μm. The elastic layer 40*b* is formed using an elastic material such as urethane rubber or chloroprene rubber, and a thickness thereof is 200-250 μm. The parting layer 40*c* decreases a depositing force of the toner on the intermediary transfer belt 40 and causes the toner to be easily transferred onto the recording material P at the secondary transfer portion T2. The parting layer 40*c* uses a single species of a resin material such as polyurethane or two or more species of materials including an elastic material such as butyl rubber, and in the parting layer 40*c*, powder or particles of fluorine-containing resin material for decreasing surface energy to enhance a lubricating property are dispersed. A thickness of the parting layer 40*c* is 5-10 μm.

(Transfer Belt)

As shown in FIG. 1, a transfer belt unit 36 causes a transfer belt 12 to carry the recording material P thereon and to pass through the secondary transfer portion T2. The transfer belt 12 facilitates separation of the recording material P from the intermediary transfer belt 40 after the transfer of the toner images. The transfer belt unit 36 stretches the transfer belt 12 by the outer secondary transfer roller 10, a separation roller 21, a tension roller 22 and a driving roller 23. A circumferential length of the transfer belt 12 is 200 mm.

The transfer belt 12 is formed of the resin material adjusted so that a volume resistivity thereof is $1\times10^9$ Ω·cm-$1\times10^{14}$ Ω·cm by adding carbon black as an antistatic agent in a proper amount into the resin material such as polyimide or polycarbonate. The transfer belt 12 has a single-layer structure and is 0.07 mm-0.1 mm in thickness. The transfer belt 12 is 100 MPa or more and less than 10 GPa in value of the Young's Modulus as measured according to a tensile test method (JIS K 6301).

The outer secondary transfer roller 10 is formed in an outer diameter of 24 mm by providing an elastic layer 10*b* of an ion conductive foam rubber (NBR) on an outer peripheral surface of a core metal 10*a* of a stainless steel round bar. The elastic layer 10*b* has a surface roughness Rz=6.0 μm-12.0 μm and Asker-C hardness of about 30-40 degrees. A resistance value of the outer secondary transfer roller 10 as measured under application of a voltage of 2 KV in a normal temperature/normal humidity environment (N/N: 23° C./50% RH) is $1\times10^5\Omega$-$1\times10^7\Omega$.

To the outer secondary transfer roller 10, a transfer power (voltage) source 11 capable of outputting a variable current is connected. The transfer power source 11 effects constant-current control of an output voltage so that a transfer current of +40 μA to +60 μA as an example flows. The transfer power source 11 applies a transfer voltage, of an opposite polarity to a charge polarity of the toner, to the outer secondary transfer roller 10, so that the toner images carried on the intermediary transfer belt 40 are secondary-transferred onto the recording material P carried on the secondary transfer belt 12. The recording material P is electrostatically attracted to the transfer belt 12 with the secondary transfer of the toner images.

The separation roller 21 separates the recording material P from the transfer belt 12. The recording material P on the transfer belt 12 is curvature-separated from the transfer belt 12 at a curved surface of the transfer belt 12 along a peripheral surface of the separation roller 21. A separation claw 33 prevents the recording material P, separated from the transfer belt 12, from electrostatically winding about the transfer belt 12 again.

The driving roller 23 is driven by a driving motor M23 and rotates the transfer belt 12 in an arrow B direction. The tension roller 22 is urged in a direction of projecting toward the transfer belt 12 by an urging spring at each of end portions thereof, and imparts a predetermined tension to the transfer belt 12.

In this embodiment, in a process in which the recording material P passes through the secondary transfer portion T2, the positive(-polarity) voltage is applied to the recording material P, so that the recording material P is attracted to the transfer belt 12. This is because as in a conventional transfer belt, when the recording material P is carried on the transfer belt 12 on a side upstream of the secondary transfer portion T2 and is fed to the secondary transfer portion T2, electric discharge generates between the recording material P and the intermediary transfer belt 40 carrying the toner images. When the recording material P is carried on the transfer belt 12 on the side upstream of the secondary transfer portion T2 and is fed to the secondary transfer portion T2, the recording material P cannot be caused to enter the secondary transfer portion T2 in a state in which the recording material P is superposed on the intermediary transfer belt 40 on the upstream side close to the secondary transfer portion T2. The electric discharge generates when the recording material P to which the positive voltage is applied through the transfer belt 12 and the intermediary transfer belt 40 carrying the toner images are superposed with each other on the side upstream of the secondary transfer portion T2, so that an image defect white dropout, transfer back (re-transfer) or white flower is caused. In addition, a constitution in which the recording material P is electrostatically attracted to the transfer belt 12 on the side upstream of the secondary transfer portion T2 also involves such a problem that a structure of a unit including the transfer belt 12 becomes large to lead to increases in cost and size of the image forming apparatus.

As described above, the inner secondary transfer roller 42 which is an example of a first transfer roller supports an inner peripheral surface of the endless intermediary transfer belt 40. The outer secondary transfer roller 10 which is an example of a second transfer roller sandwiches at least the intermediary transfer belt 40 between itself and the inner secondary transfer roller 42 to form the secondary transfer portion T2 which is an example of a transfer portion. The tension roller 41 which is an example of a stretching roller stretches the intermediary transfer belt 40, moving toward the secondary transfer portion T2, between itself and the inner secondary transfer roller 42.

(Guiding Member)

Figure 3:
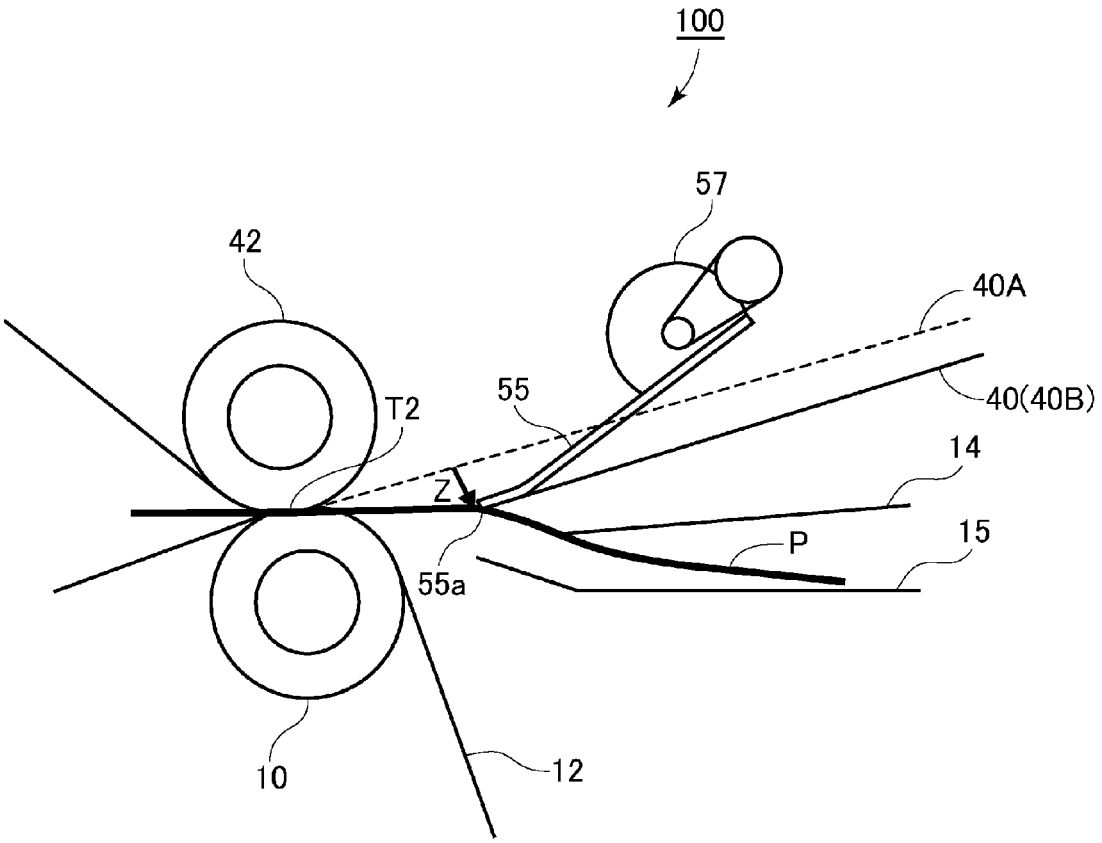
FIG. 3 is an illustration of a structure of a secondary transfer portion on an upstream side.

FIG. 3 is an illustration of a structure of the secondary transfer portion on an upstream side. As shown in FIG. 1, the registration roller pair 13 which is an example of a feeding means, an upper guide 14 and a lower guide 15 feeds the recording material P to the secondary transfer portion T2 so that the recording material P enters the secondary transfer portion T2 in a state in which the recording material P is superposed on the intermediary transfer belt 40.

As shown in FIG. 3, on a side upstream of the secondary transfer portion T2, the upper guide 14 and the lower guide 15 are disposed. The upper guide 14 and the lower guide 15 regulate a feeding path along which the recording material P is fed to the secondary transfer portion T2 and cause the recording material P to contact the intermediary transfer belt 40 at a position close to the tension roller 41 than a position where an urging member 55 urges the inner peripheral surface of the intermediary transfer belt 40 is. The upper guide 14 regulates a behavior that the recording material P approaches the surface of the intermediary transfer belt 40. The lower guide 15 regulates that the recording material P is gradually spaced from the surface of the intermediary transfer belt 40.

The recording material P is guided by the upper guide 14 and the lower guide 15 to the secondary transfer portion T2 in a state in which the recording material P is superposed on the intermediary transfer belt 40 at a position upstream of the secondary transfer portion T2.

This is because when the recording material P enters the secondary transfer portion T2 in the state in which the recording material P is superposed on the intermediary transfer belt 40 on the side upstream of the secondary transfer portion T2, the electric discharge is liable to generate between a toner image carrying surface of the intermediary transfer belt 40 and the recording material P. When the electric discharge generates between the toner image carrying surface of the intermediary transfer belt 40 and the recording material P, electric charges of the toner carried on the intermediary transfer belt are lost at an electric discharge position, and correspondingly the toner is not transferred from the intermediary transfer belt 40 onto the recording material P. As a result, the image defect which is called the white dropout, the transfer back or the white flower generates.

(Vibration of Intermediary Transfer Belt)

In the case where the urging member 55 is not provided, when the intermediary transfer belt 40 is rotated at a high speed, the intermediary transfer belt 40 is liable to vibrate during rotation. When the intermediary transfer belt 40 vibrates, a gap (spacing) is liable to generate between the recording material P and the intermediary transfer belt 40, which are superposed with each other at the position upstream of the secondary transfer portion T2, by using the upper guide 14 and the lower guide 15. Further, in order to transfer the toner images, a strong electric field is formed at the secondary transfer portion T2 by applying a high voltage to the outer secondary transfer roller 10, and therefore in the case where the gap generates between the intermediary transfer belt 40 and the recording material P, abnormal discharge is liable to generate in the gap.

When the abnormal discharge generates in the gap between the intermediary transfer belt 40 and the recording material P, as described above, the electric charges of the toner carried on the intermediary transfer belt 40 are last at a discharge position, and correspondingly, the toner images are not transferred from the intermediary transfer belt 40 onto the recording material P. As a result, the image defect which is called the white dropout, the transfer back or the white flower generates.

Therefore, in this embodiment, the urging member 55 is disposed on the inner peripheral surface side of the intermediary transfer belt 40 and urges the intermediary transfer belt 40 outwardly, so that vibration of the intermediary transfer belt 40 causing the abnormal discharge is suppressed.

(Urging Member)

In this embodiment, as shown in FIG. 3, in order to prevent generation of the image defect (the white dropout, the transfer back or the white flower) due to the electric discharge when the toner images are transferred onto the recording material P, the urging member 55 is provided on the upstream side close to the secondary transfer portion T2. The urging member 55 which is an example of an urging member urges the inner peripheral surface of the intermediary transfer belt 40 at a position close to the secondary transfer portion T2 between the inner secondary transfer roller 42 and the tension roller 41.

The urging member 55 urges the back surface of the intermediary transfer belt 50 on the upstream side close to the secondary transfer portion T2. The urging member 55 causes an intermediary transfer belt stretching surface between the inner secondary transfer roller 42 and the tension roller 41 to project toward the toner image carrying surface side. The urging member 55 alleviates the vibration of the intermediary transfer belt 40 even when the intermediary transfer belt 40 rotates at the high speed, so that the recording material P and the intermediary transfer belt 40 are closely contacted to each other on the side upstream of the secondary transfer portion T2.

The urging member 55 is a sheet-shaped elastic member formed, in a plate shape capable of contacting over a full width of the intermediary transfer belt 40, with an elastic resin material such as polyester, nylon or PET. In this embodiment, using a PET resin sheet which has already been adjusted to have a medium electric resistance, the urging member 55 is formed in a thickness of 0.4-0.6 mm and a full width of 330-380 mm.

In the case of using the PET resin sheet, when a PET resin sheet having a low electric resistance is used, there is a possibility that with application of a transfer voltage to the outer secondary transfer roller 10, a current flows through the urging member 55 and thus improper transfer generates. However, when a PET resin sheet having a high electric resistance is used, there is a possibility that the urging member 55 is triboelectric charged by rubbing with the intermediary transfer belt 40 to attract the intermediary transfer belt 40 and thus rotation of the intermediary transfer belt 40 is prevented. For this reason, the medium electric resistance is imparted to the urging member 55.

As shown in FIG. 1, the urging member 55 is supported in a cantilever shape from a supporting member 57 and a free end portion thereof is contacted to the inner peripheral surface of the intermediary transfer belt 40. The supporting member 57 is supported at each of end portions thereof by an unshown unit frame in which the tension roller 41, the inner secondary transfer roller 42 and the driving roller 43 are assembled.

As shown in FIG. 3, the urging member 55 is contacted to the inner peripheral surface of the intermediary transfer belt 40 at a free end portion 55*a* thereof elastically deformed in the cantilever shape. In this embodiment, a length and a mounting position of the urging member 55 are adjusted, so that the free end portion 55*a* is located at a position of 3-15 mm upstream of the secondary transfer portion T2 with respect to a rotational direction of the intermediary transfer belt 40.

The urging member 55 is mounted so that the free end portion 55*a* extends toward a downstream side of the intermediary transfer belt 40 with respect to the rotational direction so as not to prevent the rotation of the intermediary transfer belt 40 by stretching against the intermediary transfer belt 40. For this reason, the urging member 55 rubs the inner peripheral surface of the intermediary transfer belt 40 along a normal direction at a stable height position. The urging member 55 is pressed against the inner peripheral surface of the intermediary transfer belt 40 in a state in which the free end portion 55*a* is bent, and therefore the free end portion 55*a* surface-contacts the intermediary transfer belt 40 with a contact range to some extent.

(Urging Amount of Urging Member)

As shown in FIG. 3, a stretching surface of the intermediary transfer belt 40 by the inner secondary transfer roller 42 and the tension roller 41 (FIG. 1) in the case where the urging member 55 does not exist is a phantom stretching surface 40A. In this case, a distance from the phantom stretching surface 40A to a stretching surface 40B of the intermediary transfer belt 40 urged by the urging member 55 is defined as an urging amount Z of the urging member 55. The urging amount Z is a positional change amount, of the free end portion 55*a* of the urging member 55, necessary to move the intermediary transfer belt 40 from the phantom stretching surface 40A to the stretching surface 40B. In this embodiment, the urging member 55 is formed and disposed so that the urging amount Z is 1.0-3.0 mm.

In this embodiment, an improper transfer suppressing effect of the urging member 55 was compared by changing the urging amount Z at a plurality of levels in a range from 0 mm to 2 mm. In this experiment, continuous image formation of a magenta image on 100 sheets of A4-sized thick paper (weight per unit area: 200 g/m$^2$) was effected, and the presence or absence of the above-described image defect (white flower) on an output image due to the vibration of the intermediary transfer belt 40 was compared.

TABLE 1

| | Urging amount (mm) | | | | |
|---|---|---|---|---|---|
| | 0 | 0.5 | 1.0 | 1.5 | 2.0 |
| IT*1 | x | Δ | ○ | ○ | ○ |

*1"IT" is the improper transfer.

As shown in Table 1, in the urging amount Z of 0 mm and less than 1 mm in which the urging member 55 does not change the phantom stretching surface 40A of the intermediary transfer belt 40, the image defect due to the vibration of the intermediary transfer belt 50 generates. However, when the urging amount Z of the urging member 55 is 1.0 mm or more, it is possible to prevent the image defect due to the vibration of the intermediary transfer belt 40. With a larger urging amount Z of the urging member 55 against the phantom stretching surface 40A of the intermediary transfer belt 40, an effect of improving the image defect due to the vibration of the intermediary transfer belt 40 is higher. However, with the larger urging amount Z of the urging member 55, a sliding (rubbing) load becomes larger, so that a rotational load of the intermediary transfer belt 40 increases and thus a speed fluctuation also becomes large, and therefore in this embodiment, the urging amount Z may preferably be 3.0 mm or less.

(Rubbed Image)

As shown in FIG. 3, with a larger projection amount (urging amount Z) of the intermediary transfer belt 40 by the urging member 55, an opposing distance between the intermediary transfer belt 40 and the recording material P guided by the upper guide 14 and the lower guide 15 more narrows. When the opposing distance between the recording material P and the intermediary transfer belt 40 narrows, there is an increasing possibility that the recording material P and the intermediary transfer belt 40 rub against each other on the side upstream of the secondary transfer portion T2 and thus the toner images carried on the intermediary transfer belt 40 before the transfer are disturbed.

The recording material P, such as thick paper or coated paper, high in flexural rigidity abuts against the intermediary transfer belt 40 on a side upstream of the urging member 55 and is placed in a bent state and is liable to rub (slide) against the intermediary transfer belt 40. The recording material P having the high flexural rigidity is pressed against the intermediary transfer belt 40 in a broad range by elasticity of the recording material P at a portion, of the recording material P nipped at the secondary transfer portion T2, upstream of the secondary transfer portion T2. In the case where the recording material P is superposed on the intermediary transfer belt 40 on the side upstream of the urging member 55, the recording material P strongly rubs against the surface of the intermediary transfer belt 40 supported by the urging member 55.

When the recording material P and the intermediary transfer belt 40 strongly rub against each other, the (unfixed) toner images carried on the intermediary transfer belt 40 are disturbed, so that an image transferred and fixed on the recording material P causes the image defect. When the toner images enter the secondary transfer portion T2 and are transferred onto the recording material P in a disturbed state on the intermediary transfer belt 40, the toner images cause minute bleeding and blur on halftone dots of a fixed image, so that an image quality lowers. As a result that the toner images of dots are disturbed on the intermediary transfer belt 40, an image defect, of a rubbed image, which is called "graininess" generates on the output image.

Incidentally, in general, the rubbed image is not readily recognized visually on a line image or a plane image and is recognized as a particulate density non-uniformity on a halftone image in many cases. The toner images of dots forming density gradation of the halftone image rub against the recording material P and change a size thereof every place, so that the rubbed image is discriminated as the density non-uniformity of the halftone image.

The rubbed image generated when the recording material P was in a situation such that the recording material P rubbed against the intermediary transfer belt 40 on the side upstream of the secondary transfer portion T2 even in an image forming apparatus in which the urging member 55 was not provided on the upstream side close to the secondary transfer portion T2. However, in the constitution in which the urging member 55 is disposed, as described above, the opposing distance between the recording material P and the intermediary transfer belt 40 narrows, and therefore the rubbed image is liable to generate. With respect to the image formed in the above-described experiment using the A4-sized thick paper, a relationship between the urging amount Z of the urging member 55 and a generation state of the rubbed image was checked.

The rubbed image is sensitive to a locating position (offset amount) of the outer secondary transfer roller 10 relative to the inner secondary transfer roller 42 (to be described in more detail hereafter). For example, as in the Comparison Example (different from this embodiment) shown in FIG. 6, when a second intersection point S is positioned upstream of a first intersection point O with respect to a feeding direction of the intermediary transfer belt 40, the relationship between the urging amount Z of the urging member 55 and the generation state of the rubbed image was as shown in Table 2. Specifically, Table 2 is a result when a constitution in which the second intersection point S is disposed at a position of about 0-2 mm upstream of the first intersection point O with respect to the feeding direction of the intermediary transfer belt 40 is employed. Here, the second intersection point S is an intersection point between the phantom stretching surface 40A (common tangential line) and a rectilinear line which is perpendicular to the phantom stretching surface 40A and which passes through a rotation center of the outer secondary transfer roller 10. The first intersection point O is an intersection point between the phantom stretching surface 40A (common tangential line) and a rectilinear line which is perpendicular to the phantom stretching surface 40A and which passes through a rotation center of the inner secondary transfer roller 42.

TABLE 2

| | Urging amount (mm) | | | | |
|---|---|---|---|---|---|
| | 0 | 0.5 | 1.0 | 1.5 | 2.0 |
| RI*1 | ○ | Δ | x | x | x |

*1"RI" is the rubbed image.

As shown in Table 2, with respect to the A4-sized thick paper (weight per unit area: 200 g/m$^2$), the rubbed image generated in the urging amount Z of 1.0 mm or more.

Therefore, in this embodiment, the position of the outer secondary transfer roller 10 is defined so that a force of contact between the recording material P and the intermediary transfer belt 40 in the neighborhood of the urging member 55 on the upstream side close to the secondary transfer portion T2 is reduced.

Further, in the image forming apparatus 100 including the urging member 55, with respect to a widthwise direction perpendicular to the feeding direction, stripe-shaped non-uniformity in generation state of the rubbed image generates, and compared with the image forming apparatus in which the urging member 55 is not provided, the image defect due to the rubbed image is conspicuous. This may be attributable to the following reason.

On the back surface of the intermediary transfer belt 40, various substances such as a scattered toner component, a bleeding component from a rubber component of the driving roller and the like are deposited, and locally accumulate on the surface of the urging member 55 with a cumulative operation time of the image forming apparatus 100. Further, the deposited substances are locally formed on the surface of the urging member 55, so that projections and recesses (unevenness) are formed on the intermediary transfer belt 40 on which the urging member 55 is disposed, and thus a variation in rubbing (sliding) pressure along the urging member 55 is formed between the intermediary transfer belt 40 and the recording material P. The variation in rubbing pressure along the urging member 55 between the intermediary transfer belt 40 and the recording material P results in rubbing (sliding) non-uniformity, so that rubbed image non-uniformity is formed on the fixed image.

At a place where the deposited substances of the urging member 55 are deposited in a large amount, the urging member 55 pushes the intermediary transfer belt 40 toward the recording material side, and thus the rubbing pressure is increased. At a place where the deposited substances are not deposited, a force for pushing the intermediary transfer belt 40 toward the recording material side locally becomes small, so that the rubbing pressure lowers. The deposited substances deposited on the urging member 55 grow with the cumulative operation time of the image forming apparatus 100, and therefore the variation in rubbing pressure of the recording material P generating along the urging member 55 with respect to the widthwise direction of the intermediary transfer belt 40 gradually becomes large. Correspondingly, also the image defect due to the rubbed image in the fixed image gradually becomes conspicuous.

(Arrangement of Outer Secondary Transfer Roller)

Figure 4:
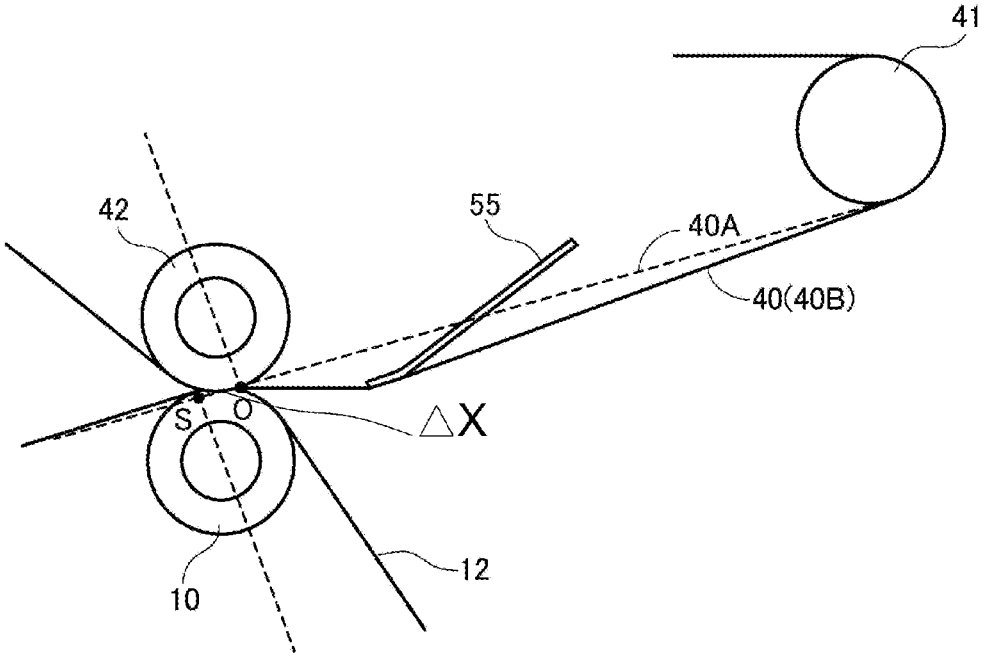
FIG. 4 is an illustration of an arrangement of an outer secondary transfer roller in Embodiment 1.
Figure 5:
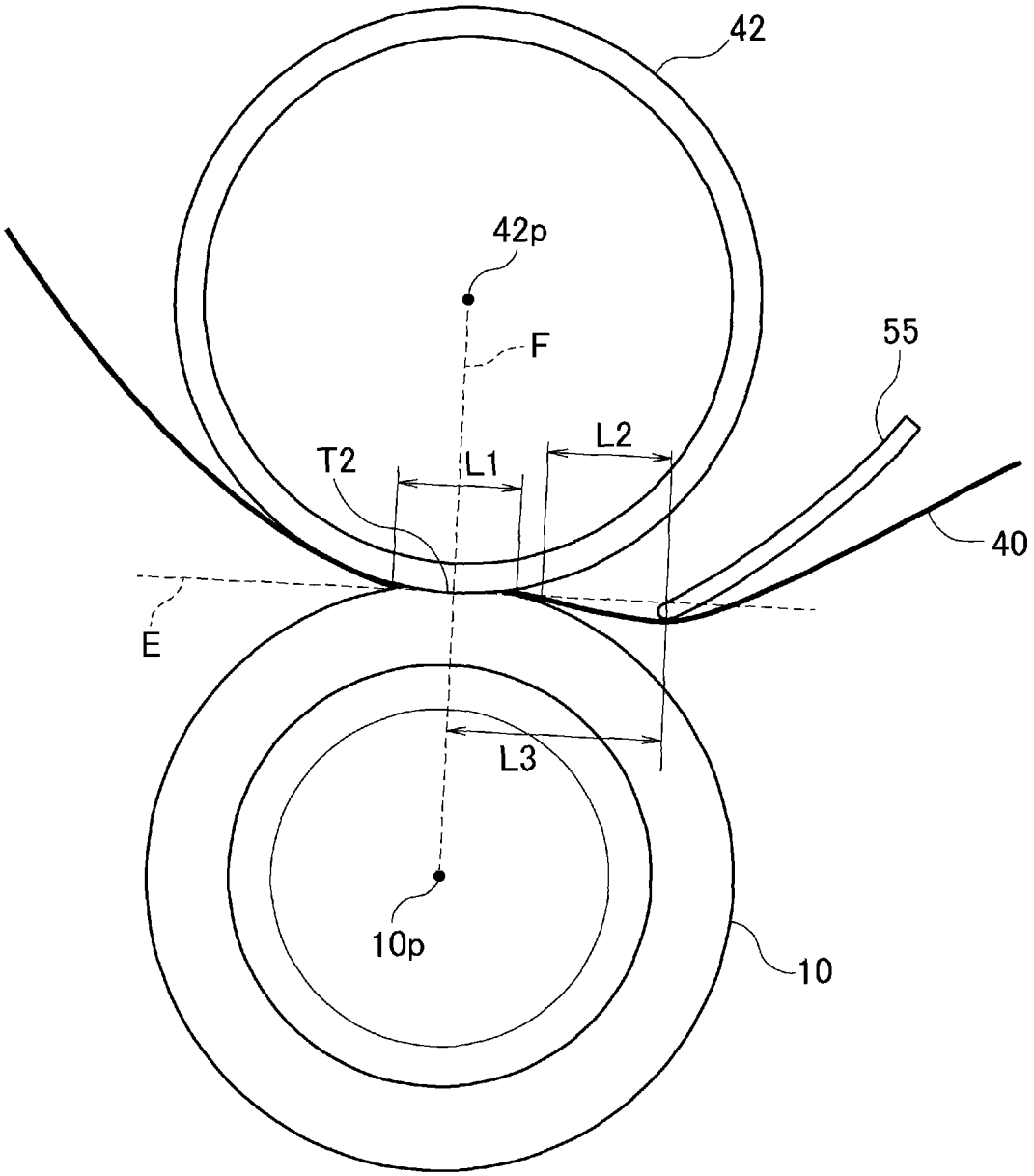
FIG. 5 is an enlarged view of the secondary transfer portion.

FIG. 4 is an illustration of an arrangement of the outer secondary transfer roller in this embodiment, and FIG. 5 is an enlarged view of the secondary transfer portion.

As shown in FIG. 4, in this embodiment, the outer secondary transfer roller 10 is disposed downstream of the inner secondary transfer roller 42 as seen in an entrance direction of the recording material P into the secondary transfer portion T2. A positional relationship between the outer secondary transfer roller 10 and the inner secondary transfer roller 42 is defined so that the outer secondary transfer roller 10 is shifted toward the downstream side compared with a conventional outer secondary transfer roller. By shifting the outer secondary transfer roller 10 toward the downstream side compared with the conventional outer secondary transfer roller, an urging force, of the recording material P nipped at the secondary transfer portion T2, exerted on the intermediary transfer belt 40 on the urging member 55 lowers, so that a degree of the rubbed image on the recording material such as the thick paper or the coated paper is alleviated compared with a conventional constitution.

As shown in FIG. 4, the phantom stretching surface 40A of the intermediary transfer belt 40 in the case where the intermediary transfer belt 40 is not urged by the urging member 55 is an enveloping surface of a common tangential line formed between the inner secondary transfer roller 42 and the tension roller 41. The phantom stretching surface 40A which is an example of the common tangential line contacts the tension roller 41 and the inner secondary transfer roller 42 in common on a stretching side of the intermediary transfer belt 40 by the inner secondary transfer roller 42.

An intersection point between the common tangential line and a rectilinear line which is perpendicular to the phantom stretching surface 40A and which passes through a rotation center of the inner secondary transfer roller 42 is a first intersection point O (i.e., a contact point between an outer common tangential line, on a stretching side of the intermediary transfer belt by the first transfer roller, between the stretching roller and the first transfer roller and the first transfer roller). An intersection point where a perpendicular line drawn from the rotation center of the inner secondary transfer roller 42 crosses the phantom stretching surface 40A is the first intersection point O. An intersection point between the common tangential line and a rectilinear line which is perpendicular to the phantom stretching surface 40A and which passes through a rotation center of the outer secondary transfer roller 10 is a second intersection point S. An intersection point where a perpendicular line drawn from the rotation center of the outer secondary transfer roller 10 crosses the phantom stretching surface 40A is the second intersection point S. In this case, the first intersection point O is positioned on the tension roller 41 side which is an example of a stretching roller side compared with the second intersection point S.

A distance Δx between the first intersection point O and the second intersection point S is defined as an offset amount Δx of the outer secondary transfer roller 10 relative to the inner secondary transfer roller 42. In this embodiment, the outer secondary transfer roller 10 is disposed so that the offset amount Δx is about 1.0 mm-2.5 mm and the second intersection point S is positioned downstream of the first intersection point O with respect to the feeding direction.

In the image forming apparatus 100 in this embodiment, the offset amount Δx was changed at 9 levels from 0.25 mm to 2.75 mm and a rubbed image generation suppressing effect was compared. In an experiment, each of the offset amounts Δx was set and a 25%-halftone image of magenta was continuously formed on entire surfaces of 100 sheets of A4-sized thick paper (weight per unit area: 200 g/m$^2$) (continuous image formation), and then the pressure or absence of generation of the rubbed image on output images was compared.

TABLE 3

| | Offset amount (mm) | | | | | | | | |
|---|---|---|---|---|---|---|---|---|---|
| | 2.75 | 2.25 | 1.75 | 1.5 | 1.25 | 1 | 0.75 | 0.5 | 0.25 |
| TP*1 | Δ | ◎ | ◎ | ○ | ○ | Δ | X | X | X |
| CP*2 | Δ | ◎ | ◎ | ○ | ○ | Δ | X | X | X |

*1"TP" is the thick paper.
*2"CP" is the coated paper.

As shown in Table 3, in this embodiment, when the offset (shift) amount Δx was 1.00 mm to 2.5 mm, the rubbed image generation suppressing effect was confirmed. Further, when the offset amount Δx was 2.25 mm or 1.75 mm, the rubbed image was not generated on the output image.

As shown in FIG. 5, a diameter of the inner secondary transfer roller 42 is 21 mm. A nip length L1 of the secondary transfer portion T2 is 3-4 mm. A distance L3 from a plane including a rotation center 42*p* of the inner secondary transfer roller 42 and a rotation center 10*p* of the outer secondary transfer roller 10 to a position where the urging member 55 contacts the intermediary transfer belt 40 is 7 mm. A distance L2 from a position where the intermediary transfer belt 40 contacts the outer secondary transfer roller 10 to the position where the urging member 55 contacts the intermediary transfer belt 40 is 2-3 mm.

When the offset amount Δx is represented by % using the diameter (d) of the inner secondary transfer roller 42, data in Table 3 are represented as follows.

TABLE 4

| | Offset amount Δx/d (%) | | | | | | | | |
|---|---|---|---|---|---|---|---|---|---|
| | 13 | 10 | 8 | 7 | 6 | 5 | 4 | 2.5 | 1.5 |
| TP*1 | Δ | ◎ | ◎ | ○ | ○ | Δ | X | X | X |
| CP*2 | Δ | ◎ | ◎ | ○ | ○ | Δ | X | X | X |

*1"TP" is the thick paper.
*2"CP" is the coated paper.

As shown in Table 4, a preferred distance between the first intersection point O and the second intersection point S is 5% or more of the diameter of the inner secondary transfer roller 42. A further preferred distance between the first intersection point O and the second intersection point S is 10% or more of the diameter of the inner secondary transfer roller 42. In addition, a preferred distance between the first intersection point O and the second intersection point S is less than 20% of the diameter of the inner secondary transfer roller 42.

A phantom flat surface (plane) E shown in FIG. 5 is a flat surface (plane) which is perpendicular to a plane F including the rotation center of the inner secondary transfer roller 42 and the rotation center of the outer secondary transfer roller and which contacts the inner secondary transfer roller 42 on the stretching side of the intermediary transfer belt 40 by the inner secondary transfer roller 42. The recording material P passing through the secondary transfer portion T2 is fed along this phantom flat surface E. As in this embodiment, in the case where the second intersection point S is disposed on the downstream side, when the urging amount Z is small, the recording material P is separated from the intermediary transfer belt 40 at an upstream portion in the neighborhood of the secondary transfer portion T2 and is liable to cause improper transfer due to electric discharge. In this embodiment, by using the urging amount Z of the urging member 55 described above with reference to Table 2, the improper transfer is prevented from generating.

That is, such an urging amount Z that the position where the urging member 55 urges the intermediary transfer belt 40 enters the outer secondary transfer roller 10 side relative to the phantom flat surface E is employed. In this embodiment, the intermediary transfer belt 40 is urged by the free end portion 55*a* of the urging member 55, and therefore the urging position is a position (free end position) where the free end portion 55*a* urges the intermediary transfer belt 40. A detailed result showing the result of Table 1 shown above is Table 5 shown below. Table 5 shows an entering distance of the intermediary transfer belt 40 relative to the phantom flat surface E at the free end position of the urging member 55 when the urging amount Z of the urging member 55 is changed.

As in this embodiment, in the case where the offset amount Δx is about 2.0 mm, when the urging amount Z of the urging member 55 is 0 mm, the entering distance of the intermediary transfer belt 40 relative to the phantom flat surface E is more than −1.0 mm and not more than −0.5 mm (>−1.0 mm and ≤0.5 mm). Further, when the urging amount Z is 0.5 mm, the entering distance is more than −0.5 mm and not more than 0 mm (>−0.5 mm and ≤0 mm). In these cases, in the neighborhood of the secondary transfer portion T2, the recording material P and the intermediary transfer belt 40 are separated from each other, so that a state in which the image defect due to the electric discharge is liable to generate is formed.

On the other hand, when the urging amount Z is 1.0 mm, the entering distance is more than 0 mm and not more than 0.5 mm (>0 mm and ≤0.5 mm). Further, when the urging amount Z is 1.5 mm, the entering distance is more than 0.5 mm and not more than 1.0 mm (<0.5 mm and ≤1.0 mm), and when the urging amount is 2.0 mm, the entering distance is more than 1.0 mm and not more than 1.5 mm (>1.0 mm and ≤1.5 mm). In these cases where the entering distance is more than 0 mm, in the neighborhood of the secondary transfer portion T2, the recording material P and the intermediary transfer belt 40 are in close contact with each other, so that the improper transfer due to the electric discharge can be suppressed. In this embodiment, this can be achieved when the urging amount Z of the urging member 55 is 1.0 mm or more.

TABLE 5

| | | | | | |
|---|---|---|---|---|---|
| UA*1 | 0.0 | 0.5 | 1.0 | 1.5 | 2.0 |
| ED*2 | >−1.0 & ≤0.5 | >−0.5 & ≤0.0 | >0 & ≤0.5 | >0.5 & ≤1.0 | >1.0 & ≤1.5 |
| IT*3 | x | Δ | ○ | ○ | ○ |

*1"US" is the urging amount (mm).
*2"ED" is the entering distance (mm) relative to the phantom flat surface E.
*3"IT" is the improper transfer.

Comparison Example 1

Figure 6:
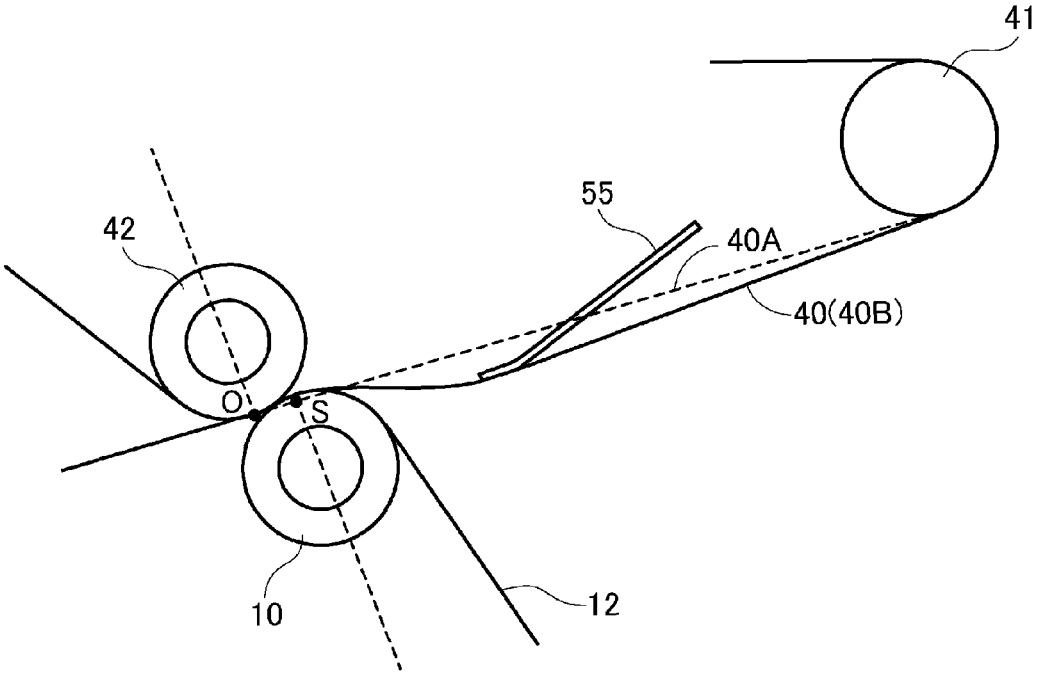
FIG. 6 is an illustration of an arrangement of an outer secondary transfer roller in Comparison Example 1.

FIG. 6 is an illustration of an arrangement of an outer secondary transfer roller in Comparison Example 1. As shown in FIG. 6, in Comparison Example 1, in contrast with Embodiment 1, the outer secondary transfer roller 10 is disposed so that the second intersection point S is located at a position upstream of the first intersection point O with respect to the feeding direction of the intermediary transfer belt 40. In this case, the outer secondary transfer roller 10 raises the intermediary transfer belt 40 to a position higher than the phantom stretching surface 40A on a side upstream of the secondary transfer portion T2. Further, on a side upstream of the outer secondary transfer roller 10, the urging member 55 presses the intermediary transfer belt 40 to a position lower than the phantom stretching surface 40A, and therefore the intermediary transfer belt 40 forms an S-curve from the inner secondary transfer roller 42 to the urging member 55.

In a process in which the intermediary transfer belt 40 moves from the urging member 55 to the inner secondary transfer roller 42 while forming the S-curve, it would be considered that the surface of the elastic layer 40*b* (FIG. 2) of the intermediary transfer belt 40 expands and contracts in the feeding direction and thus the rubbed image generates. For this reason, with a softer and thicker elastic layer of the intermediary transfer belt 40, a degree of expansion and contraction of the intermediary transfer belt surface between a projected portion and a recessed portion of the S-curve with respect to the feeding direction becomes larger and thus the rubbed image is conspicuous.

In Comparison Example 1, different from a state in which the intermediary transfer belt 40 is only pushed outwardly by the urging member 55 as in Embodiment 1, the intermediary transfer belt 40 is deformed by the outer secondary transfer roller 10 so that the S-curve having a large amplitude is drawn. For this reason, it would be considered that a degree of a change in thickness of the elastic layer of the intermediary transfer belt 40 is large on the side upstream of the secondary transfer portion T2 and thus the rubbed image due to the change in thickness of the elastic layer increases.

On the other hand, in Embodiment 1, a locus of the S-curve is not formed on the side upstream of the secondary transfer portion T2 or the amplitude of the S-curve is small, and therefore the degree of expansion and contraction of the surface of the intermediary transfer belt 40 with respect to the feeding direction on the side upstream of the secondary transfer portion T2 is small. For this reason, it would be considered that the rubbed image becomes inconspicuous.

Comparison Example 2

As shown in FIG. 1, in order to prevent the vibration of the intermediary transfer belt 40, in place of the provision of the urging member 55, it would be also considered that a tension applied to the intermediary transfer belt 40 by the tension roller 41 is increased by a pressing spring 45. This is because when the urging member 55 is not disposed, the amplitude of the S-curve of the intermediary transfer belt 40 on the side upstream of the secondary transfer portion T2 becomes small and thus the rubbed image does not readily generate.

However, a range in which there is a need to suppress the vibration is limited to a range of several 10 mm on the side upstream of the secondary transfer portion T2, but it is undesirable that the tension of an entirety of the intermediary transfer belt 40 is increased. When the tension of the intermediary transfer belt 40 is increased, a driving load of the intermediary transfer belt 40 increases, so that a bearing lifetime of the stretching roller shortens. There is also a possibility that vibration and noise of the entire image forming apparatus become large.

In order to suppress the vibration of the intermediary transfer belt 40 in a limited region on the upstream side close to the secondary transfer portion T2, a method in which the urging member 55 is provided and caused to support the intermediary transfer belt 40 so as to project outwardly is effective.

Further, in Embodiment 1, the urging member 55 changes its position with respect to an urging direction of urging the inner peripheral surface of the intermediary transfer belt 40 depending on an urging force received from the inner peripheral surface. For this reason, compared with the fixed supporting member as in JP-A 2002-82543 described above, the urging member 55 does not readily increase the contact pressure between the recording material P and the intermediary transfer belt 40. Accordingly, image disturbance and the rubbed image due to the increase in contact pressure between the recording material P and the intermediary transfer belt 40 do not readily generate.

Comparison Example 3

The improper transfer (the white dropout, the transfer back or the like) generating due to the vibration of the intermediary transfer belt 40 is liable to generate when a deterioration state of the toner progresses. For this reason, also by keeping a degree of the deterioration state of the toner in the developing device at a low level by forcedly consuming the toner periodically and then by supplying a fresh toner to the developing device, the generation of the improper transfer can be suppressed to some extent.

However, when the toner is forcedly consumed frequently, a consumption amount of the toner which is not used for image formation increases, so that a running cost of the image forming apparatus increases. For this reason, in order to prevent the improper transfer (the white dropout, the transfer back or the like) generating due to the vibration of the intermediary transfer belt 40, it is more efficient that the urging member 55 is disposed at a position close to and upstream of the secondary transfer portion T2 and thus the intermediary transfer belt 40 is projected outwardly.

(Influence of Elastic Layer)

As described above, the rubbed image is more liable to generate in the case where the intermediary transfer belt includes the elastic layer than in the case where the intermediary transfer belt does not include the elastic layer and is more liable to generate in the case where the intermediary transfer belt includes a thick elastic layer than in the case where the intermediary transfer belt includes a thin elastic layer. This may be attributable to the following reason.

The rubbed image is formed by relative movement of the recording material P and the intermediary transfer belt 40 in a movement direction in a contact state, and therefore is more conspicuous with an increasing surface speed difference between the recording material P and the intermediary transfer belt 40 in a contact region therebetween. The urging member 55 moves the intermediary transfer belt 40 in a thickness direction with a fluctuation in contact pressure of the recording material P with the intermediary transfer belt 40. In the case where the intermediary transfer belt includes the thick elastic layer, a degree of increase and decrease of the pressure is alleviated with the movement of the intermediary transfer belt 40 in the thickness direction, and on the other hand, a degree of expansion and contraction of the elastic layer surface with respect to the feeding direction becomes large, so that the rubbed image is generated.

Alternatively, when the intermediary transfer belt 40 is projected outwardly by the urging member 55, the intermediary transfer belt 40 including the elastic layer decreases in thickness in a process in which the intermediary transfer belt 40 passes through the urging member 55, so that the surface speed thereof changes. The intermediary transfer belt 40 is larger in fluctuation of the surface speed, with a thicker and softer elastic layer, in the process in which the intermediary transfer belt 40 passes through the urging member 55. For this reason, even when another factor is the same, the intermediary transfer belt 40 including the elastic layer causes a conspicuous rubbed image.

On the other hand, in Embodiment 1, the S-curve is not formed on the intermediary transfer belt 40 on the side upstream of the secondary transfer portion T2 or even when the S-curve is formed, the amplitude thereof is small. For this reason, the degree of expansion and contraction of the surface of the intermediary transfer belt 40 with respect to the feeding direction on the side upstream of the secondary transfer portion T2 becomes small, so that the rubbed image becomes inconspicuous.

(Transfer Belt)

As shown in FIG. 4, in Embodiment 1, the outer secondary transfer roller 10 is disposed so that the second intersection point S is positioned downstream of the first intersection point O with respect to the feeding direction of the intermediary transfer belt 40. For this reason, the intermediary transfer belt 40 does not form the S-curve formed by raising the intermediary transfer belt 40 by the outer secondary transfer roller 10 on the side upstream of the secondary transfer portion T2.

However, in the case where the outer secondary transfer roller 10 is disposed downstream of the inner secondary transfer roller 42 with respect to the feeding direction, an attitude of the recording material P coming out of the secondary transfer portion T2 faces in a direction in which the recording material P approaches the intermediary transfer belt 40. For this reason, when the recording material P is thin paper having a low rigidity, the recording material P adheres to the intermediary transfer belt 40 and thus is liable to cause separation failure.

Therefore, in Embodiment 1, the transfer belt 12 is provided, so that the recording material P on which the toner images are transferred at the secondary transfer portion T2 is forcedly separated from the intermediary transfer belt 40. The transfer belt 12 electrostatically attracts the recording material P at the secondary transfer portion T2 and separates the recording material P from the intermediary transfer belt 40 on an exit side of the secondary transfer portion T2 to prevent a jam of the recording material P due to the separation failure. By using the transfer belt 12, feeding of the thin paper in the secondary transfer portion T2 is stabilized, so that it is also possible to suppress the image disturbance and the transfer non-uniformity.

Accordingly, in Embodiment 1, a problem, which is generated by disposing the second intersection point S downstream of the first intersection point O with respect to the feeding direction of the intermediary transfer belt 40, is solved by the transfer belt 12.

Effect of Embodiment 1

In Embodiment 1, the recording material P enters the secondary transfer portion T2 in the close contact state with the intermediary transfer belt 40, and therefore the electric discharge that would cause the improper transfer between the intermediary transfer belt 40 and the recording material P does not generate. For this reason, it is possible to suppress the generation of the image defect (the white dropout, the transfer back or the white flower) due to the electric discharge when the toner images are transferred onto the recording material P.

In Embodiment 1, the pressure, by which the portion of the recording material P nipped at the secondary transfer portion T2, upstream of the secondary transfer portion T2, urges upwardly the intermediary transfer belt 40 supported by the urging member 55, is small. When the recording material P enters the secondary transfer portion T2, the force by which the recording material P is pressed against the intermediary transfer belt 40 on the side upstream of the secondary transfer portion T2 is reduced. For this reason, strong rubbing of the recording material P and the intermediary transfer belt 40 against each other on the side upstream of the secondary transfer portion T2 is eliminated, so that it is possible to reduce the rubbed image when the image is formed on the thick paper or the coated paper. Even on the high-rigidity thick paper or the high-rigidity coated paper, the rubbed image generated by strong rubbing between the recording material and the intermediary transfer belt 40 does not readily generate.

The image forming apparatus 100 in Embodiment 1 is capable of preventing the generation of the rubbed image due to the strong rubbing of the recording material and the intermediary transfer belt 40 against each other while preventing the generation of the image defect (the white dropout, the transfer back or the white flower) due to the electric discharge when the toner images are transferred onto the recording material P.

Embodiment 2

Figure 7:
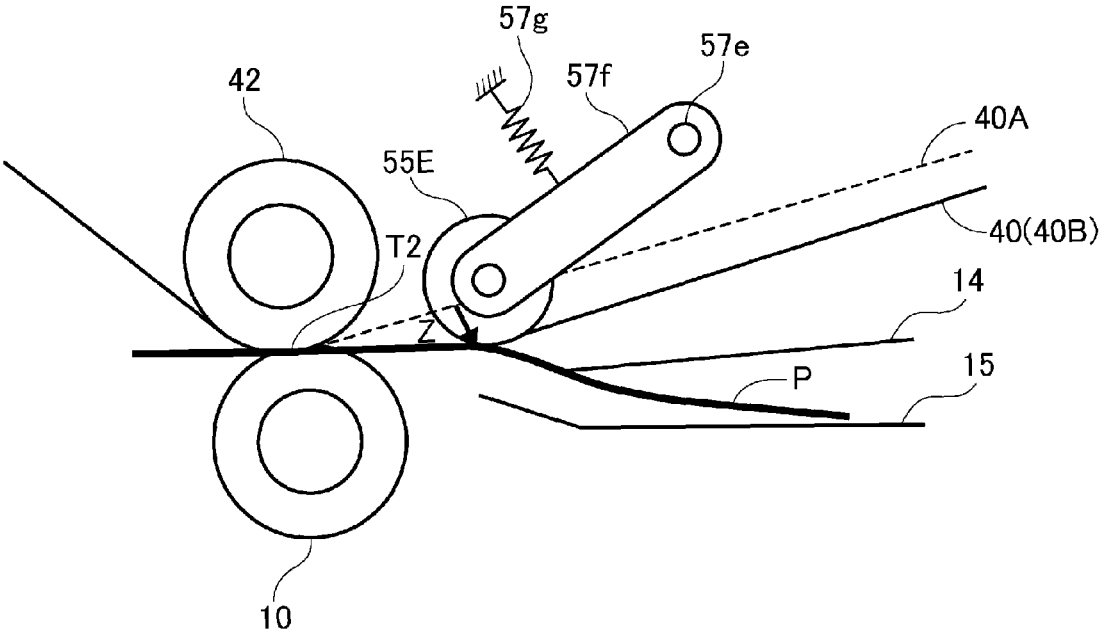
FIG. 7 is an illustration of an urging member in Second Embodiment.

FIG. 7 is an illustration of an urging member in this embodiment. In Embodiment 1, on the side upstream of the secondary transfer portion T2, the sheet-shaped urging member of the elastic resin material was disposed and thus the intermediary transfer belt 40 was projected outwardly. On the other hand, in this embodiment, a roller-shaped urging member was disposed on the side upstream of the secondary transfer portion T2 and thus the intermediary transfer belt 40 was projected outwardly.

As shown in FIG. 7, a pair of unit frames of an intermediary transfer belt unit is provided with a rotation shaft 57*e* around which an arm 57*f* is rotatably mounted. At a rotation end of the arm 57*f*, an urging roller 55E is rotatably mounted and uniformly contacts the inner peripheral surface of the intermediary transfer belt 40 over a full width of the inner peripheral surface. The urging roller 55*e* is urged toward the intermediary transfer belt 40 by an urging spring 57*g* provided between the unit frame and the arm 57*f*.

A positional relationship between the inner secondary transfer roller 42 and the outer secondary transfer roller 10 is the same as that in Embodiment 1.

As shown in FIG. 4, the phantom stretching surface 40A includes the common tangential line contacting the tension roller 41 and the inner secondary transfer roller 42 in common on the stretching side of the intermediary transfer belt 40 in a plane perpendicular to the rotation center of the inner secondary transfer roller 42. The intersection point between the common tangential line and the rectilinear line which is perpendicular to the common tangential line and which passes through the rotation center of the inner secondary transfer roller 42 is the first intersection point O. The intersection point between the common tangential line and the rectilinear line which is perpendicular to the common tangential line and which passes through the rotation center of the outer secondary transfer roller 42 is the second intersection point S. In this case, the first intersection point O is positioned on the tension roller 41 side relative to the second intersection point S. When the distance $\Delta x$ between the first intersection point O and the second intersection point S is defined as the offset distance $\Delta x$, the offset distance $\Delta x$ is about 1.00 mm-2.5 mm.

The urging member disposed at the upstream position close to the secondary transfer portion T2 is capable of preventing the vibration of the intermediary transfer belt 40 even when the urging member is the roller-shaped urging roller 55E. Also an arrangement of the urging roller 55E relative to the intermediary transfer belt 40 is similar to that in Embodiment 1. That is, the position where the urging roller 55E urges the intermediary transfer belt 40 enters the outer secondary transfer roller 10 side relative to the phantom flat surface E (FIG. 5).

Other Embodiments

In Embodiment 1, the embodiment in which the toner images were transferred onto the recording material P by using the transfer belt 12 stretched by the outer secondary transfer roller 10 was described. However, the present invention can also be carried out in an embodiment in which the secondary transfer portion T2 is formed between the intermediary transfer belt 40 and the outer secondary transfer roller 10 without using the transfer belt 12.

In Embodiment 1, the urging member 55 is supported by the unit frame of the intermediary transfer belt unit detachably mountable to the apparatus main assembly of the image forming apparatus 100. However, the urging member 55 may also be supported by a frame (not shown) of the apparatus main assembly of the image forming apparatus 100.

The image forming apparatus 100 may also be a printer, a facsimile machine, a copying machine, a multi-function machine, and the like.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Applications Nos. 2015-112020 filed on Jun. 2, 2015, and 2016-040270 filed on Mar. 2, 2016, which are hereby incorporated by reference herein in their entirety.

What is claimed is:

1. An image forming apparatus comprising:

an endless intermediary transfer belt;

a toner image forming unit configured to form a toner image on said intermediary transfer belt at an image forming portion;

a first transfer roller contacting an inner peripheral surface of said intermediary transfer belt;

a second transfer roller configured to sandwich said intermediary transfer belt between itself and said first transfer roller to form a transfer portion where the toner image is transferred from said intermediary transfer belt onto a recording material;

an urging member configured to urge said intermediary transfer belt from the inner peripheral surface of said intermediary transfer belt at an urging portion, the urging portion being provided adjacent to and upstream of the transfer portion with respect to a movement direction of said intermediary transfer belt; and a stretching roller, configured to stretch said intermediary transfer belt between itself and said first transfer roller in contact with the inner peripheral surface of said intermediary transfer belt at a stretching portion, the stretching portion being provided adjacent to and upstream of the urging portion and downstream of the image forming portion with respect to the movement direction of said intermediary transfer belt, wherein as viewed in a direction of a rotational axis of said first transfer roller, (1) a contact point between (i) an outer common tangential line, on a stretching side of said intermediary transfer belt, of said stretching roller and said first transfer roller, and (ii) said first transfer roller, and (2) an intersection point between the outer common tangential line and a rectilinear line which is perpendicular to the outer common tangential line and which passes through a rotation center of said second transfer roller satisfy that the intersection point is disposed more downstream than the contact point with respect to a direction in which the recording material is fed at the transfer portion, and that a distance between the contact point and the intersection point is 5% or more of a diameter of said first transfer roller.

2. An image forming apparatus according to claim 1, wherein as viewed in the direction of the rotational axis of said first transfer roller, said urging member urges said intermediary transfer belt so that at least a part of said intermediary transfer belt at the urging portion enters a second transfer roller side relative to a tangential line of said first transfer roller, on the stretching side of said intermediary transfer belt, the tangential line being perpendicular to rectilinear lines passing through the rotation centers of said first transfer roller and said second transfer roller.

3. An image forming apparatus according to claim 1, wherein the distance between the contact point and the intersection points is 10% or more of the diameter of said first transfer roller.

4. An image forming apparatus according to claim 1, wherein the distance between the contact point and the intersection points is less than 20% of the diameter of said first transfer roller.

5. An image forming apparatus according to claim 1, further comprising a guide member configured to guide the recording material fed toward the transfer portion, said guide member causing the recording material to contact said intermediary transfer belt at a position upstream of the urging portion with respect to the movement direction of said intermediary transfer belt.

6. An image forming apparatus according to claim 1, further comprising an endless transfer belt, supported by a plurality of supporting rollers including said second transfer roller, configured to feed the recording material onto which the toner image is transferred at the transfer portion.

7. An image forming apparatus according to claim 1, wherein said urging member is a sheet shaped member having a free end portion which extends toward the transfer portion and which is contacted to the inner peripheral surface of said intermediary transfer belt.

8. An image forming apparatus according to claim 1, wherein said intermediary transfer belt has an elastic layer.

9. An image forming apparatus comprising:

an endless intermediary transfer belt;

a toner image forming unit configured to form a toner image on said intermediary transfer belt at an image forming portion;

a first transfer roller contacting an inner peripheral surface of said intermediary transfer belt;

a second transfer roller configured to sandwich said intermediary transfer belt between itself and said first transfer roller to form a transfer portion where the toner image is transferred from said intermediary transfer belt onto a recording material;

an endless transfer belt, supported by a plurality of supporting rollers including said second transfer roller, configured to feed the recording material onto which the toner image is transferred at the transfer portion;

a sheet shaped member, having a free end portion which extends toward the transfer portion and which is contacted to the inner peripheral surface of said intermediary transfer belt, configured to urge said intermediary transfer belt from the inner peripheral surface of said intermediary transfer belt at an urging portion, the urging portion being provided adjacent to and upstream of the transfer portion with respect to a movement direction of said intermediary transfer belt; and a stretching roller configured to stretch said intermediary transfer belt between itself and said first transfer roller in contact with the inner peripheral surface of said intermediary transfer belt at a stretching portion, the stretching portion being provided adjacent to and upstream of the urging portion and downstream of the image forming portion with respect to the movement direction of said intermediary transfer belt, wherein as viewed in a direction of a rotational axis of said first transfer roller, (1) a contact point between (i) an outer common tangential line, on a stretching side of said intermediary transfer belt, of said stretching roller and said first transfer roller, and (ii) said first transfer roller, and (2) an intersection point between the outer common tangential line and a rectilinear line which is perpendicular to the outer common tangential line and which passes through a rotation center of said second transfer roller satisfy that the intersection point is disposed more downstream than the contact point with respect to a direction in which the recording material is fed at the transfer portion, and that a distance between the contact point and the intersection point is 5% or more of a diameter of said first transfer roller.

* * * * *